US005092258A

United States Patent [19]

Goldbeck et al.

[11] Patent Number: 5,092,258

[45] Date of Patent: Mar. 3, 1992

[54] METHOD AND DEVICE FOR PRODUCING POCKET OPENINGS

[75] Inventors: Heinz Goldbeck, Bielefeld; Eckhard Schalk, Spenge, both of Fed. Rep. of Germany

[73] Assignee: Durkoppwerke GmbH, Fed. Rep. of Germany

[21] Appl. No.: 419,032

[22] Filed: Oct. 10, 1989

[30] Foreign Application Priority Data

Oct. 10, 1988 [DE] Fed. Rep. of Germany ..... 3834434
Oct. 10, 1988 [DE] Fed. Rep. of Germany ... 8812703[U]

[51] Int. Cl.[5] ..... D05B 21/00

[52] U.S. Cl. ..... 112/262.3; 112/121.12; 112/104

[58] Field of Search ..... 112/68, 70, 65, 67, 112/262.3, 121.12, 121.15, 121.11, 104

[56] References Cited

U.S. PATENT DOCUMENTS 4,034,689 7/1977 Hintzen et al. ..... 112/68
4,281,606 8/1981 Beisler ..... 112/121.15
4,589,358 5/1986 Goldbeck et al. ..... 112/68
4,928,608 5/1990 Schips ..... 112/104 X

*Primary Examiner*—Peter Nerbun
*Attorney, Agent, or Firm*—Ostrolenk, Faber, Gerb & Soffen

[57] ABSTRACT

A method and apparatus for automatically making a pocket opening having a flap and a pocket bag, one half of the pocket-bag blank being sewn to the workpiece together with the flap and the piping strip. The formation of the seam takes place as a function of the detected presence of the flap. During the transport of the workpiece, flap, and blank to the sewing place, the part of the pocket-bag blank which rests on the flap is lifted off of the flap, the presence of the flap is detected by an opto-electronic sensor, and the pocket bag is again placed on the flap before the parts are sewn together. The sewing machine is controlled in response to the sensor so that the seam corresponds precisely to the length of the flap. The pocket-bag blank is lifted off and replaced on the flap by a folder which has an arrangement of guide plates for carrying out the invention.

23 Claims, 7 Drawing Sheets

METHOD AND DEVICE FOR PRODUCING POCKET OPENINGS

BACKGROUND OF THE INVENTION

The present invention relates to a method of producing a pocket opening having a flap, a piping strip, and a pocket bag on an automatic sewing machine, and a device for carrying out this method.

The assignee Dürkoppwerke GmbH manufactures a sewing machine under the name Dürkopp 745 by means of which pocket openings having flaps can be produced automatically.

For this purpose, the workpiece which is to be provided with the pocket opening, for instance the front part of a jacket or trousers, or a part of a coat, is aligned on the work plate which is located in front (that is, in advance) of the sewing region. Above this there is arranged, on the one side, a flap-application and transfer device such as is known, for instance, from Federal Republic of Germany OS 26 56 720, equivalent to U.S. Pat. No. 4,281,606 and, on the other side, an application device for the piping strip and the pocket bag. The disclosures of this document and all other prior art materials cited herein are expressly incorporated by reference. The piping strip and the pocket bag are inserted into the appropriate application device and aligned, and the flap is inserted into the application device. The piping strip, pocket bag and flap are lowered onto the workpiece, and fixed there by means of the sewing-material clamp, whereupon all parts are transported into the sewing region.

The length of the applied flap is detected by an optical sensor which is functionally connected with the control of the sewing machine and the formation of the seam is so controlled that the seam extends precisely over the entire length of the flap. After the piping strip and the pocket bag are sewed together to the workpiece, on the one hand, and after the flap, piping strip and workpiece are sewed together on the other hand, the pocket opening is cut in known manner (Federal Republic of Germany OS 34 04 758, equivalent to U.S. Pat. No. 4,589,358).

In the case of a pocket opening produced by this method, the free end of the pocket bag which is connected to the piping strip must then be sewn to the flap in order to close the pocket bag, which requires a relatively complicated operation.

According to another method, it is also known to place half of a pocket bag on the flap and half on the piping strip, sew them together to the workpiece and then close the two pocket bag halves in simple manner to each other, for instance by an overcast stitch. Since the flap is covered in this way by the half of the pocket bag which rests on it, the length of the flap cannot be detected by an optical sensor after it is transported into the sewing region, so that it is necessary to work with a constant seam length. There is the disadvantage here that, as a result of manufacturing tolerances, the prefabricated flaps differ in length from one another, so the proper formation of the seam does not always take place.

SUMMARY OF THE INVENTION

In view of these disadvantages in the prior art, the main object of the present invention to provide a method for the production of a pocket opening having a flap and a pocket bag which makes it possible to control the seam to be formed as a function of the specific length of the flap, and without the known disadvantages.

A further important object is to provide a device for carrying out the method which is of simple construction and assures dependable work.

This object with respect to the method can be achieved by a method of providing a workpiece with a pocket opening having a flap and a pocket bag on an automatic sewing machine, comprising the steps of:

aligning the workpiece at a point in advance of a sewing region with respect to a direction of transport, placing the flap on the workpiece and a pocket bag blank on the flap and securing the flap and pocket bag blank relative to the workpiece;

then transporting the workpiece, flap, and pocket bag blank into the sewing region while maintaining their relative position;

locating a sensor at a predetermined point in advance of the needles of the sewing machine;

during said transport, lifting part of the pocket-bag blank off the flap and thereby exposing the flap to the sensor; and thereby detecting the leading and trailing ends of the flap during the transport;

replacing the lifted part of the pocket-bag blank on the flap after the flap passes by the sensor in the direction of transport, and sewing the flap, pocket-bag blank and workpiece together; and controlling the automatic sewing machine such that the sewing of the seam is controlled by the detected presence of the flap.

One advantageous feature of the method invention is that it is possible in making a pocket opening to produce both a seam length which is precisely adapted to the length of the flap, and also to form the pocket bag by simply sewing together the two pocket-bag halves. In this way, a pocket opening of high quality can be produced at low cost within a short period of time.

Advantageous further developments of the method are disclosed and claimed herein.

A device for carrying out the method can be a device for providing a workpiece with a pocket opening which includes a flap and a pocket bag, on an automatic sewing machine which has a sewing point, comprising:

means for receiving a workpiece, a flap, and a pocket bag blank and securing them relative to one another;

transport means for transporting the workpiece, flap, and pocket bag blank in a transport direction to the sewing point of the automatic sewing machine while maintaining them in their relative position;

sensor means at a predetermined point upstream from said sewing point for detecting the presence of said flap; and control means responsive to said sensor means for controlling the sewing machine and the transport means so as to begin sewing a seam to attach said workpiece, flap, and blank a predetermined time after a leading end of the flap is detected by the sensor, and to stop sewing said seam a predetermined time after a trailing end of the flap is detected by the sensor.

One particularly advantageous feature of the invention is the folder, which allows traditional sewing machines to be rapidly and inexpensively converted for making pocket openings by the method of as disclosed and claimed herein. Other advantageous embodiments of the device are disclosed and claimed herein.

Other objects, features and advantages of the invention will be appreciated from the following detailed description of an embodiment thereof, with reference to the drawings.

DETAILED DESCRIPTION

Structure of the Sewing Machine

Figure 1:
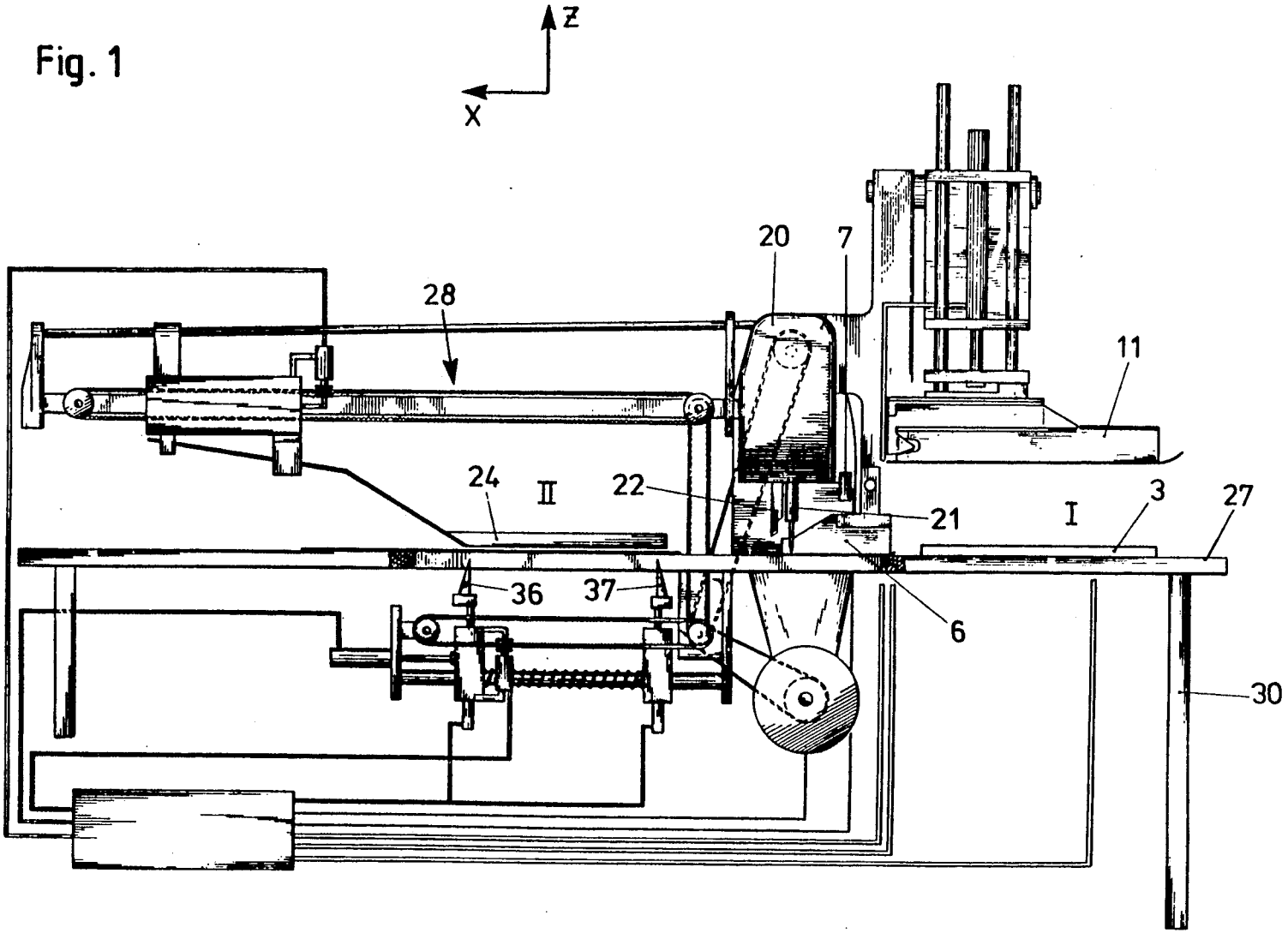
FIG. 1 is a diagrammatic view of a sewing machine according to a preferred embodiment of the invention.

FIG. 1 is a diagrammatic view of a sewing machine for the production of pocket openings which includes a double-needle sewing machine 20 having a knife 22 which carries out vertical cutting movements arranged between the needle bars or needles 21, 21*a*. It also includes a gripper 11, a sewing-material clamp which is horizontally displaceable and consists of two halves 25, 25*a*, and a cutting device formed of two wedge-shaped knives 36, 37 arranged behind the place of sewing (downstream in the transport direction) and below the top surface of the frame 30.

In front of the place of sewing (upstream with respect to the transport direction) an optoelectronic sensor 7 is arranged above the folder 6 and, together with a reflective foil 40 glued onto the sewing-material clamp half 25, forms a light barrier. The sewing-material clamp 24 is connected to a clamp drive 28 and can be transferred horizontally below the sewing place, as defined by the needle bars 21, 21*a*, from the transfer region I into the cutting region II (x-direction).

Figure 7:
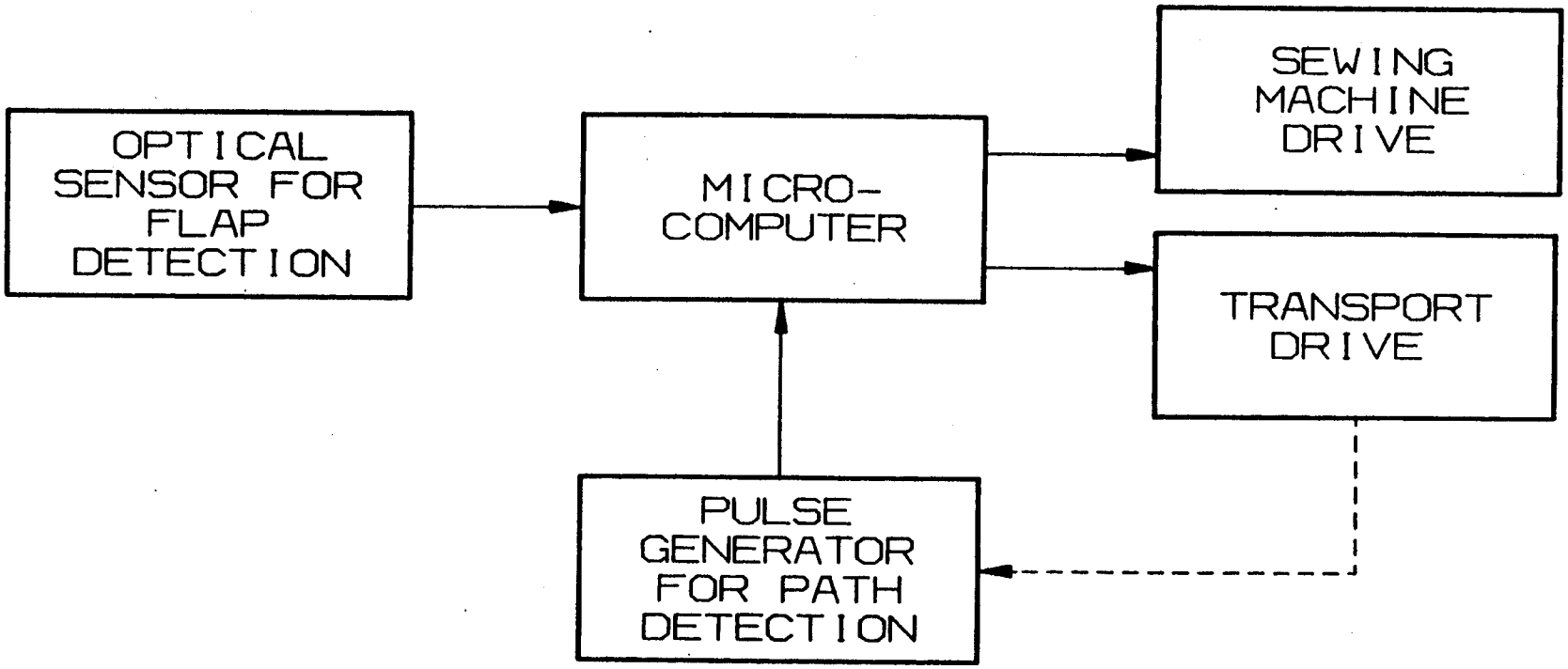
FIG. 7 is a block diagram of the control system.

The sewing machine is provided with a microcomputer control which, in addition to the formation of the stitch, also controls the auxiliary equipment. For this purpose, the sewing-material clamp 24 is operatively connected with a pulse generator in order to detect the transport path over which it moves. The sensor 7 is also connected to the microcomputer control and, in combination with the data representing the path over which the sewing-material clamp moves, provides the necessary data for the formation of the seam and the control of the wedge-shaped knives 36, 37 (Federal Republic of Germany OS 34 04 758). A block diagram of the control system is shown in FIG. 7.

Figure 5:
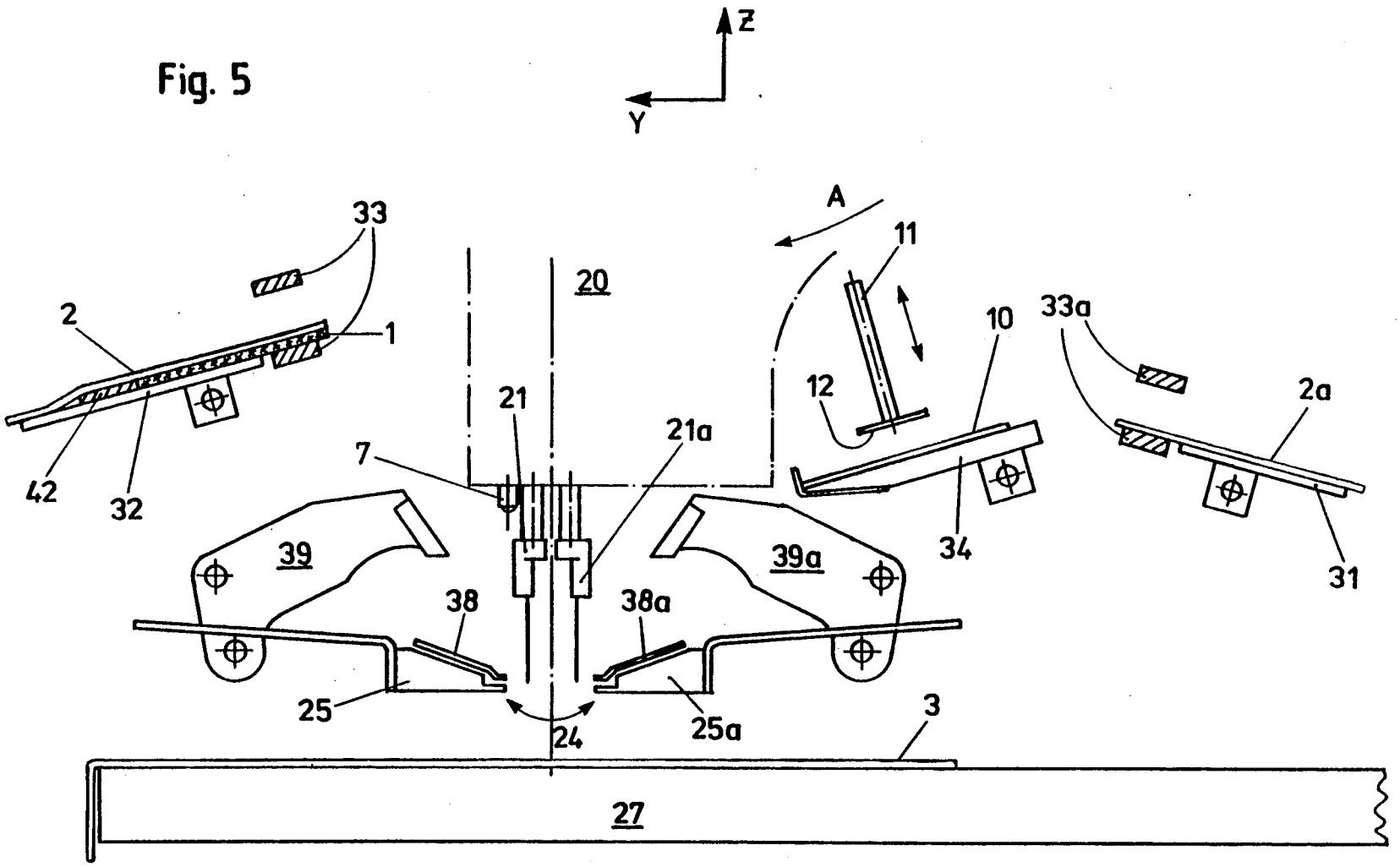
FIG. 5 is a simplified diagrammatic side view showing the starting position of the application and transfer devices of the sewing machine.

The gripper 11 is swingably arranged in advance of (upstream from) the sewing place, with respect to the direction of transport, and above the work plate 27 (as seen in the plane of FIG. 1) and is adapted to be lowered vertically onto the work plate 27. In the starting position, as indicated in FIG. 5, the gripper 11 is raised and swung backwards, so that it is vertically above the piping strip applicator 34, the latter being arranged inclined relative to the work plate 27.

On its lower side 12, the gripper 11 is provided with lowerable needles (not shown in detail) which are moved outward in order to grip the piping strip 10 and are then drawn in again after the piping strip has been placed on the workpiece 3.

The gripper 11 is provided with a nose 13 (FIG. 3) on the side thereof which supports the flap 1, together with the applied half of the pocket-bag blank 2. This nose 13 protrudes from the gripper 11 in the direction of the flap 1, and is located at the end of the gripper 11 adjoining the folder 6. It is so shaped that it lifts the pocket-bag blank 2, lying on the flap 1, off from the gripper 11.

The gripper 11 is well known per se from the publicly distributed Dürkopp 745 sewing machine; as well as from the publications DÜRKOPP Instructions 745-5, -7, -15, pp. 71-78; Spare Parts List, FIG. 24 published Oct. 1986, and FIG. 26, published Oct. 1987; and from the published brochure DÜRKOPP UND ADLER 745. All of the foregoing are expressly incorporated by reference herein.

Figure 2:
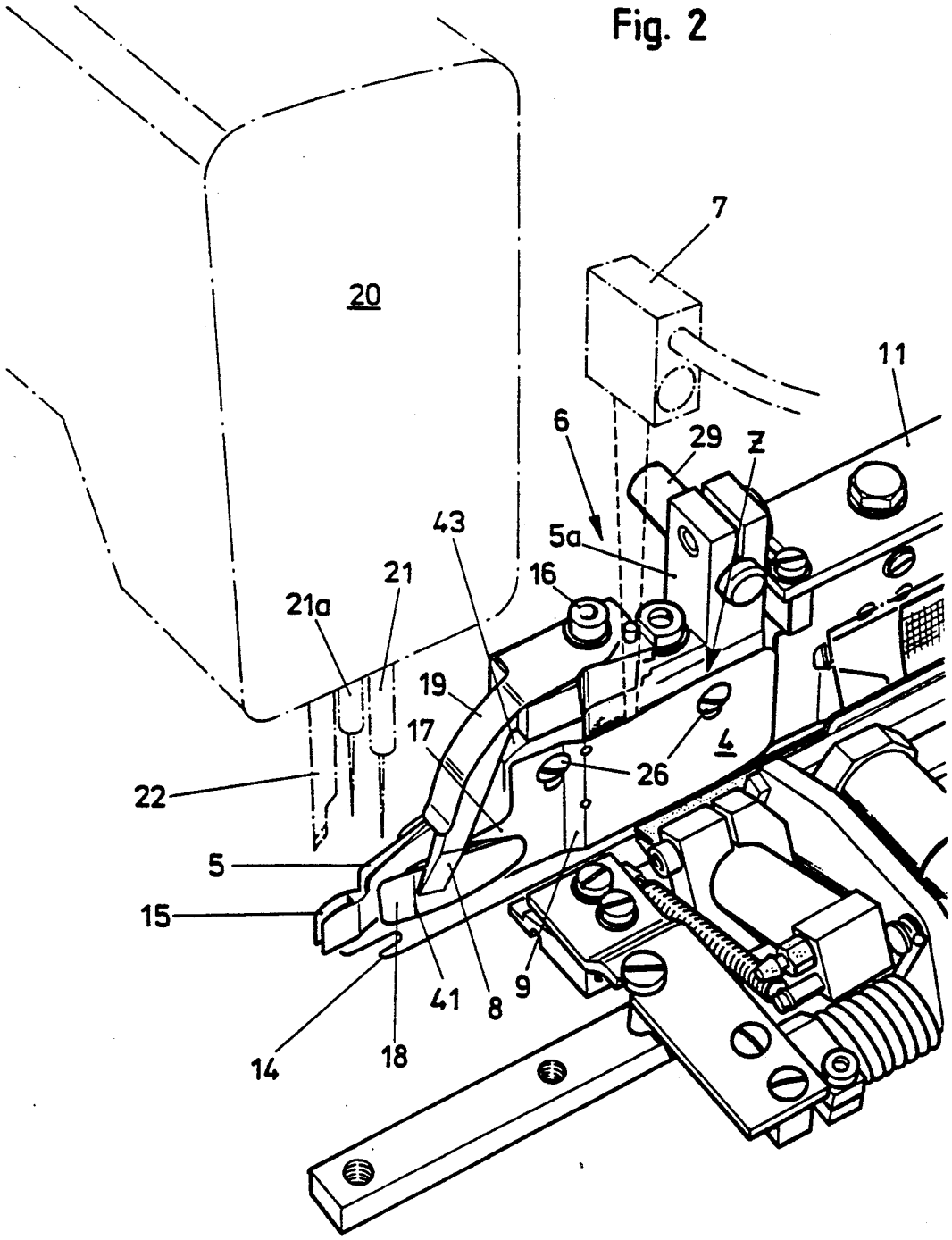
FIG. 2 is a perspective detail view showing the folder, which forms part of the sewing machine.

FIG. 2 shows the folder 6, which includes a bridge 5, a bridge carrier 5*a*, and a guide plate 4. A yoke 8 with a guide plate 18 fastened thereon is mounted swingably on the bridge carrier 5*a*. The folder mounte 6 is arranged fixed in space at a location in advance of the sewing place. For this purpose there is fastened on the bridge carrier 5*a* another carrier 29 which, in turn, is connected, in a manner not shown in detail, to the sewing machine 20. The folder 6 also has a foot 14 formed on the bridge 5. The folder 6 does not lie directly on the work plate 27 but is raised therefrom to such an extent that the workpiece 3 and the piping strip 10 resting on it can be moved below the folder 6.

The rectangular guide plate 4 is arranged via two screws 26 on the bridge carrier 5*a*, spaced from it, and has a projection 17 which protrudes from the lower edge and extends in the direction of transport. The spacing must be selected large enough that, on the one hand, the flap 1 can be moved between the bridge 5 and the guide plate 4. As a general rule this can be easily arranged, since the bridge carrier 5*a* is wider (thicker) than the bridge 5. On the other hand, the spacing must be small enough for the sensor 7 arranged above the folder to be able to cover the region Z between bridge 5 and guide plate 4. A bend 9 is formed in the front quarter of the rectangular part of the guide plate 4 in such a manner that the front part of the guide plate 4 is at a smaller distance from the bridge 5 than its rear part. The projection 17 extends horizontally in the direction of transport and toward the bridge 5 at an angle of approximately 10° to the XZ-plane. It terminates about 5 mm away from the bridge 5, as measured in the Y-direction.

The yoke 8 is fastened swingably over the bridge 5 on the bridge carrier 5*a*. This yoke is bent in the direction of the foot 14 and is provided at its lower end with an approximately triangular guide plate 18. The lower edge of the guide plate 18 extends, slightly arched, at an angle of about 65° to the vertical, in the direction toward the bridge carrier 5*a*. In its lowest position, the yoke 8 strikes against a stop 43 formed on the bridge 5, so that the lowest corner of the guide plate 18 extends approximately to the lower edge of the guide plate 4. As shown in FIG. 2, the yoke 8 is bent in the XZ-plane so that the projection 17 formed on the guide plate 4 is enclosed between the bridge 5 and the guide plate 18.

Furthermore, the guide plate 18, which is perpendicular to the XY-plane, is inclined to the XZ-plane at an angle of about 10°, just like the projection 17 of the guide plate 4. Projection 17 and guide plate 18 are accordingly arranged in part parallel to each other. At a point on the guide plate 18 corresponding to the front edge of the projection 17 (i.e., at the point designated 41), the guide plate 18 is so bent that it passes from its course parallel to the projection 17 into a course parallel to the bridge 5. That is, the projection 17 of the guide plate 4 terminates in the transport direction at about the location of the bend 41 formed in the guide plate 18.

The purpose of the guide plate 18 is to bring the flap 1 together with the part of the pocket-bag blank 2 which was raised by the nose 13 away from the gripper 11 and then passed along the outer surface of the guide plate 4. Thus, the flap 1 and the blank 2 are brought together before they reach the sewing place.

In the basic position, the yoke 8 which bears guide plate 18 is held normally at all times in the lowermost position by the spring plate 19 which is fastened by the screws 16 also to the bridge carrier 5*a*. That is, the yoke 8 is pressed against the stop 43 on the bridge carrier 5*a* by the spring plate 19. By this swingable arrangement of the yoke 8 and the guide plate 18, it is assured that the pocket-bag blank 2 will always be dependably held against the flap 1 even if the blank consists of thicker material.

In front of the bridge 5, as seen in the direction of transport of the material (X-direction), the knife guard 15 is developed in known manner, within which guard the knife 22 travels upon the cutting of the pocket insert (Z-direction), the guard keeping both the flap 1 and the pocket-bag blank 2 which rests on it away from the knife 22, thus preventing damage to said parts.

Operation of the Sewing Machine

The course of production of a pocket opening with pocket bag will now be explained with reference to FIGS. 5 and 6. In this connection it should be pointed out that the sewing machine is substantially known and that some of the additional equipment such as the transfer devices, sewing-material clamp and gripper have been sold for a long time by the assignee of the present invention (see the publication "DÜRKOPP & ADLER, KATALOG IMB '88").

Referring to FIGS. 1 and 5, the workpiece 3 which is to be provided with the pocket opening is aligned by means of marking lights in region I, in front (in advance) of the sewing machine 20. The flap 1 is placed on the application plate 32 which is arranged above the work plate 27 and aligned with the stop 42. One half of the pocket-bag blank 2 is placed on the flap 1. It should be noticed that at this point in time, the clamp 33 of the transfer device (not shown in detail) cannot contact both the flap 1 and the pocket-bag blank 2. The piping strip 10 is placed and aligned on the piping strip applicator 34 and the other half of the pocket bag 2*a* is placed and aligned on the application plate 31.

The sewing-material clamp 24 moves into the transfer region I and descends onto the workpiece 3. In this connection, the end position which it is to assume is so determined that the gripper 11 can subsequently be swung precisely between the two clamp halves 25, 25*a* (as will be seen hereinbelow in connection with FIG. 6). At the same time, the gripper 11 descends in the direction of the application plate 34, grips the piping strip 10 via the needles (not shown in detail here) arranged on its lower side 12, moves back into the starting position, carries out a swinging motion (arrow A) until it is directly above the sewing-material clamp 24 in a position between the clamp halves 25, 25*a* and in line with the sewing needles 21, 21*a*, and then descends onto the workpiece 3.

Figure 6:
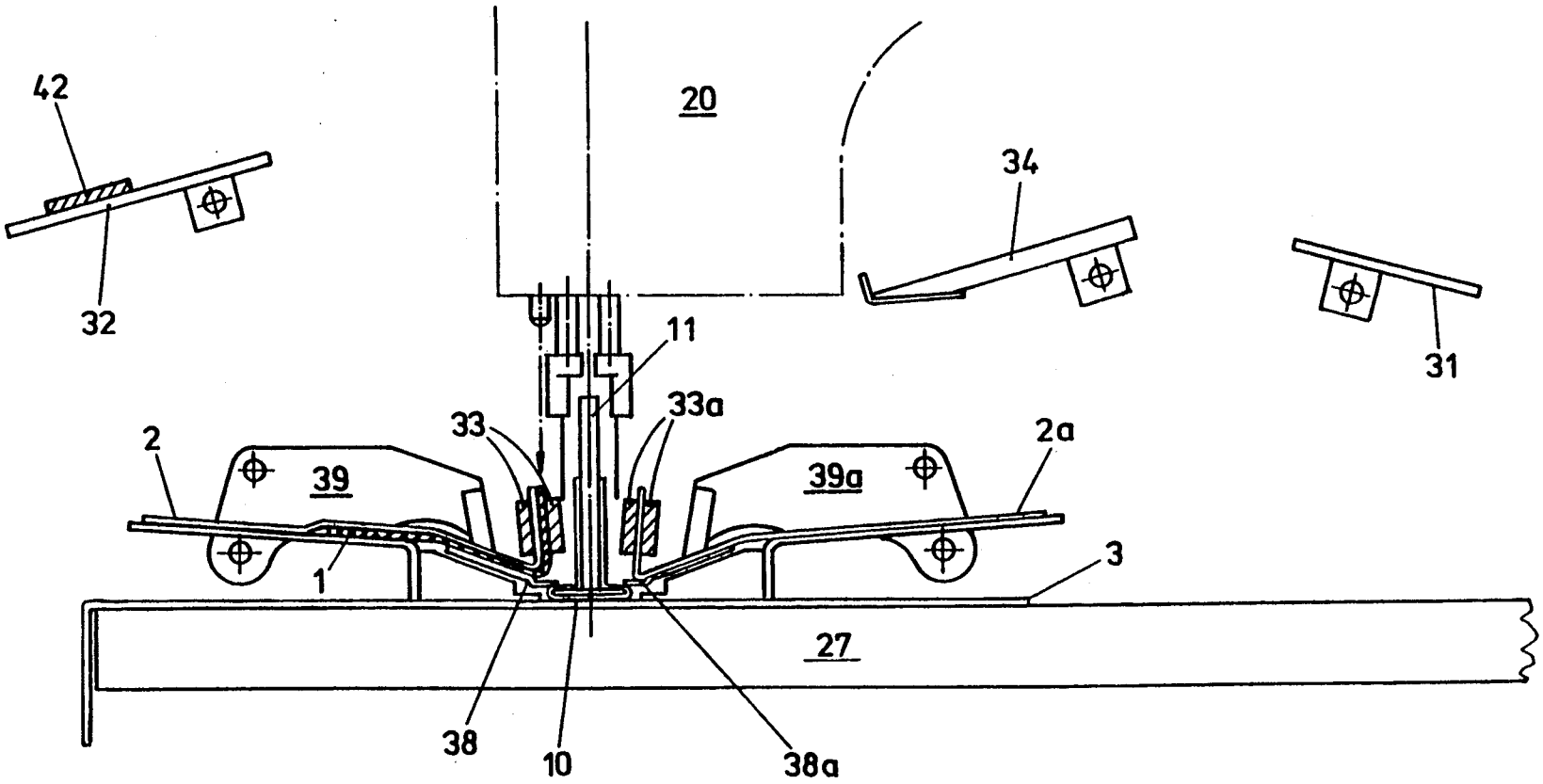
FIG. 6 is a view similar to FIG. 5 showing the application and transfer devices after the folding of the piping strip and the transfer of the flap, but before the start of the transport of the sewing material.

Now referring to FIG. 6, the fold plates 38 and 38*a* are displaced in the direction of the gripper 11, as a result of which the piping strip 10 is folded around the gripper 11. The clamps 33 and 33*a* of the transfer devices close and are swung so that the flap 1 with the pocket-bag blank 2 resting on it comes to rest on the fold plate 38 of the sewing-material clamp 24 and the pocket-bag blank 2*a* comes to rest on the fold plate 38*a*. The flap clamps 39, 39*a* are then closed, as a result of which the flap 1 and the pocket-bag half 2 on the one hand, and the pocket-bag half 2*a* on the other hand, are fixed in the sewing-material clamp 24.

FIG. 6 shows the position now assumed by all parts of the sewing material. The clamps 33, 33*a* are loosened and the sewing-material clamp 24 is transported in the direction toward the sewing needles 21, 21*a*. The piping strip 10 is held so forcefully by the folding plates 38, 38*a* that upon the displacement of the sewing material clamp 24 it is pulled along with the latter, below the gripper 11 and the folder 6.

Figure 3:
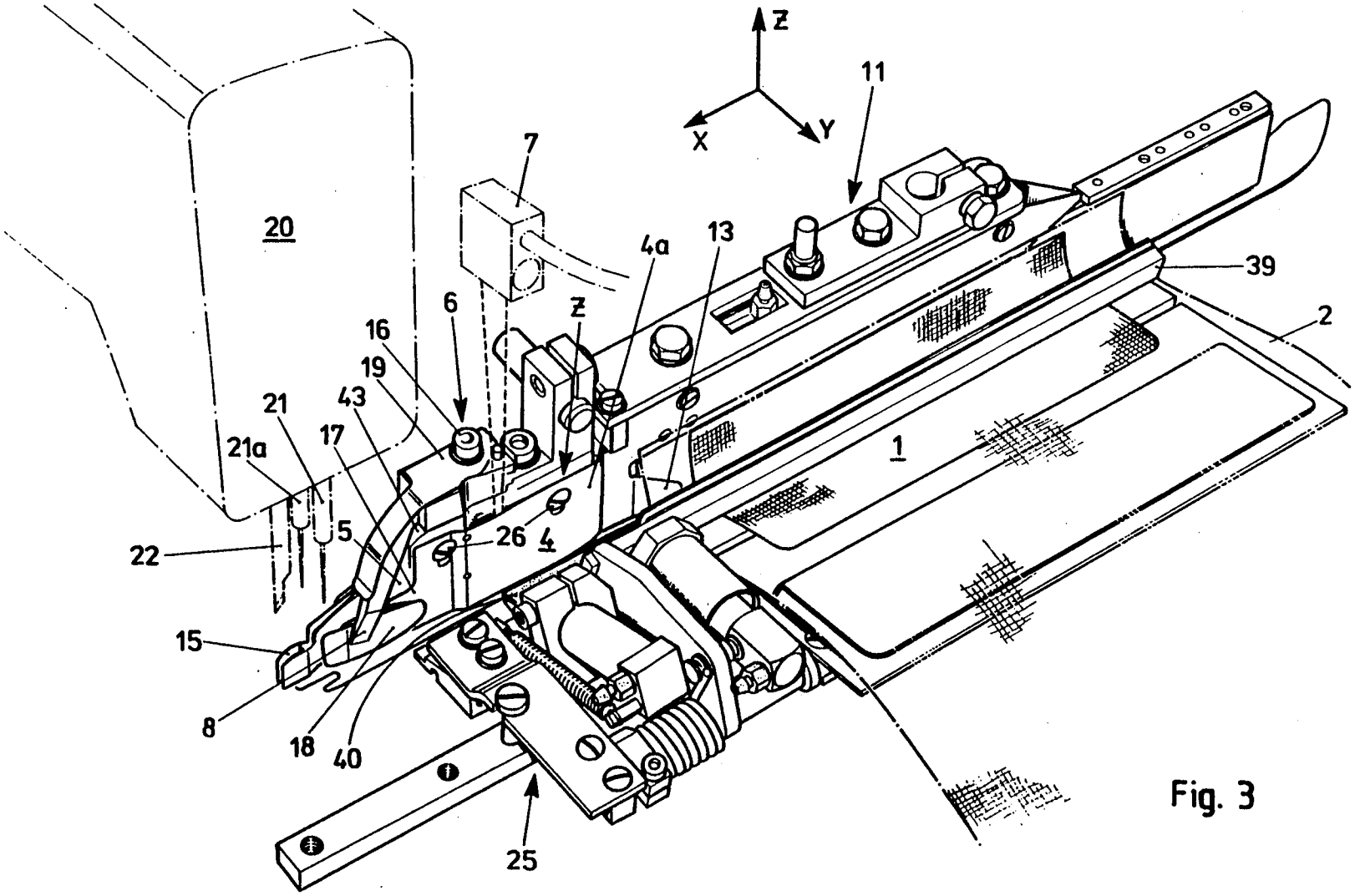
FIG. 3 is a perspective view showing the folder, the gripper arranged in front of it (toward the right in FIG. 1), and one of the halves of the sewing-material clamp.
Figure 4:
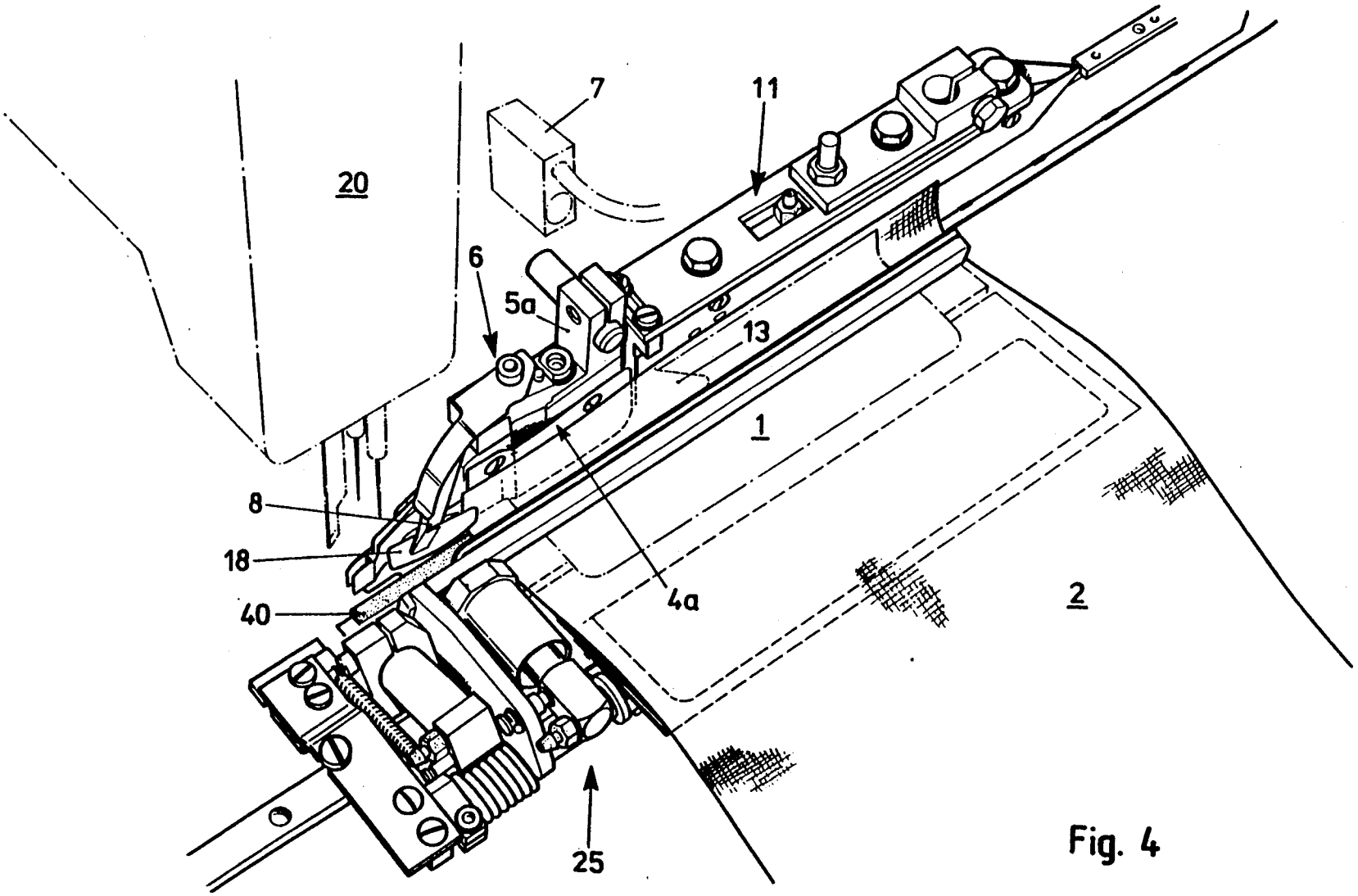
FIG. 4 shows the arrangement of FIG. 3 during the phase of transport of the sewing material.

The further course of the process is best seen from FIGS. 3 and 4, which provide a partial perspective view of the gripper 11, with the folder 6 arranged fixed in place downstream from it in the travel direction, and with the flap 1 and the pocket-bag blank 2 clamped in the clamp half 25.

From FIG. 3 it can be seen that part of the flap 1 is turned up against the gripper 11. The pocket-bag blank 2, which is shown in dashed lines, has its corner which is toward the sewing needle 21 turned away from the gripper 11 by the nose 13 formed on the latter. Note that the blank 2 overlies the flap 1 as seen in FIG. 3, but the flap 1 is visible because the blank 2 is shown in phantom. During the transport of the sewing-material clamp 24, the clamp half 25 pulls the flap 1 between the nose 13 and the gripper 11 so that, as it travels further, it passes into the intermediate space Z which is formed by the guide plate 4 and the bridge 5 within the fold stamp 6, while the pocket-bag blank 2 moves along the side 4*a* (FIG. 3) of fold plate 4 facing away from the bridge 5.

The optical sensor 7, which is arranged above the fold stamp 6 and covers the region Z between the bridge 5 and the guide plate 4, forms a light barrier with the reflective foil 40 which is arranged on the sewing-material clamp half 25. At the moment when the edge of the flap 1 interrupts this light barrier, the pulse generator, which is operatively connected with the sewing-material clamp 24, is switched on by the microcomputer control and the transport path now moved over is detected. Since the distance from the sensor 7 to the sewing needles 21, 21*a* is fixed, a known number of pulses, which must then be counted from the time of the detection of the edge by the sensor 7 until the start of the formation of the seam in order to let the first stitch be formed at the beginning of the flap 1, is also fixed.

During the further course of the transport of the workpiece, the pocket-bag blank 2 enters into the region between the yoke 8 and the guide plate 4 (FIG. 4) and, since the downstream region of the guide plate 4 and the yoke 8 extend at an angle of about 10° to the bridge, the blank 2 again comes into contact with the flap 1. At the place where the two parts 1 and 2 again lie against each other, the stitch is formed and the flap 1, together with the pocket-bag blank 2 and the piping strip 10, is sewn onto the workpiece 3.

At the same time, the pocket-bag blank 2*a* (not shown in detail here), which is guided on the other side of the gripper 11, is also sewn to the piping strip 10 and the workpiece 3.

The knife 22, which is arranged between the needles and downstream from the needles in the direction of transport, cuts the pocket opening during the transport of the sewing material. When the rear edge of the flap 1 reaches the sensor 7, the light barrier is again released and the sensor 7 gives off a signal to the electronic control. From the defined distance of the sensor 7 from the needles 21, 21*a*, the distance is determined over which the sewing-material clamp must still move until the stitching is stopped so that the end of the seam will coincide with the end of the flap, and at the same point, the formation of the cut by the knife 22 is interrupted.

The number of pulses of the pulse generator which have taken place, from the time the light barrier is interrupted until the time it is released, is stored in the electronic control in known manner and constitutes a measure of the length of the flap. These stored data serve in known manner (Federal Republic of Germany OS 34 04 758) to control the wedge-shaped knives 36, 37.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A method of providing a workpiece with a pocket opening having a flap and a pocket bag on an automatic sewing machine, comprising the steps of:

aligning the workpiece at a point in advance of a sewing region with respect to a direction of transport, placing the flap on the workpiece and a pocket bag blank on the flap and securing the flap and pocket bag blank relative to the workpiece;

then transporting the workpiece, flap, and pocket bag blank into the sewing region while maintaining their relative position;

locating a sensor at a predetermined point in advance of needles of the sewing machine;

during said transport, lifting part of the pocket-bag blank off the flap and thereby exposing the flap to the sensor; and thereby detecting the leading and trailing ends of the flap during the transport;

replacing the lifted part of the pocket-bag blank on the flap after the flap passes by the sensor in the direction of transport, and sewing the flap, pocket-bag blank and workpiece together; and controlling the automatic sewing machine such that the sewing of the seam is controlled by the detected presence of the flap.

2. A method according to claim 1, wherein the part of the pocket-bag blank nearest the location where the seam is to be formed is lifted off from the flap.

3. A method according to claim 2, wherein the flap and the pocket-bag blank resting on it are separated prior to the sewing step by moving them past a folder having a bridge and a guide plate, such that the flap enters into a region between the bridge and the guide plate while the pocket-bag blank is guided along the outside of the guide plate, which is the side facing away from the bridge.

4. A method according to claim 3, wherein the flap is detected by the sensor while the flap is present between the bridge and the guide plate.

5. A method according to claim 1, further comprising the step of cutting the pocket opening during said transport and during the sewing of the seam at a point just downstream from said sewing point.

6. A device for providing a workpiece with a pocket opening which includes a flap and a pocket bag, on an atomatic sewing machine which has a sewing point, comprising:

means for receiving a workpiece, a flap, and a pocket bag blank and securing them relative to one another;

transport means for transporting the workpiece, flap, and pocket bag blank in a transport direction to the sewing point of the automatic sewing machine while maintaining them in their relative position;

sensor means at a predetermined point upstream from said sewing point for detecting the presence of said flap;

separating means for separating a part of the pocket bag blank from the flap upstream from said sensor means, thereby exposing said flap to be detected by said sensor means;

replacing means for replacing said part of the pocket bag blank on the flap downstream from said sensor means and upstream from said sewing point for permitting said workpiece, flap, and pocket bag blank to be sewn together; and control means responsive to said sensor means for controlling the sewing machine and the transport means so as to begin sewing a seam to attach said workpiece, flap, and blank a predetermined time after a leading end of the flap is detected by the sensor, and to stop sewing said seam a predetermined time after a trailing end of the flap is detected by the sensor.

7. A device as in claim 6, wherein said separating means is at a downstream part of said receiving and securing means; and said device further comprising guide means for guiding said flap and pocket bag blank downstream in their separated state past said sensor means.

8. A device as in claim 7, wherein said guide means is a folder disposed upstream from the sewing point and downstream from said receiving and securing means; said folder comprising a generally vertical bridge; a main guide plate arranged spaced from at least one side of said bridge and generally parallel to said bridge; said main guide plate being arranged so that said flap is received from said separating means between said main guide plate and bridge and guided past said sensor means; and said pocket bag blank is received from said separating means and guided on the side of said main guide plate facing away from said bridge; said sensor means being arranged for detecting the presence of said flap between said main guide plate and said bridge.

9. A device as in claim 8, further comprising a second main guide plate arranged spaced from and generally parallel to the other side of said bridge.

10. A device according to claim 8, wherein the main guide plate has a bend such that that its upstream end, as seen in the direction of transport, is a greater distance away from the bridge than its downstream end.

11. A device as in claim 10, wherein the downstream end of the main guide plate extends at an angle of about 10° to the transport direction.

12. A device as in claim 10, further comprising a yoke secured at its upstream end to the bridge and having at its downstream end a second guide plate which extends generally parallel to the downstream end of the main guide plate.

13. A device as in claim 12, wherein the yoke is mounted on the bridge so as to be swingable in a plane parallel to the transport direction.

14. A device as in claim 13, wherein the yoke is biased downward by a spring force toward the sewing material.

15. A device as in claim 14, wherein the yoke rests in its lowest position against a stop which is formed on the bridge.

16. A device as in claim 12, wherein the second guide plate has a triangular shape and its lowest edge is its longest edge and extends from the direction of the sewing material toward the bridge in a generally upward and upstream direction.

17. A device as in claim 16, wherein said longest edge of the second guide plate extends at an angle of about 65° to the vertical.

18. A device as in claim 12, wherein the lowest downstream corner of the second guide plate terminates at substantially the same height from the sewing material as the lowest edge of the main guide plate.

19. A device as in claim 12, wherein the second guide plate is provided in its downstream region with a bend such that the second guide plate passes from its course generally parallel to the main guide plate upstream from said bend, into a course toward the bridge, downstream of said bend.

20. A device as in claim 19, wherein the downstream part of the main guide plate terminates substantially adjacent to the bend in the second guide plate.

21. A device as in claim 12, wherein the second guide plate extends generally at an angle of about 10° to the travel direction.

22. A device as in claim 8, wherein the sensor means is arranged above the folder so as to detect the region between the bridge and the main guide plate.

23. A device as in claim 6, further comprising means for cutting the pocket opening during the transport at a point just downstream from the sewing point.

* * * * *